US005477796A

United States Patent [19]

Nedoschinsky et al.

[11] Patent Number: 5,477,796

[45] Date of Patent: Dec. 26, 1995

[54] SEWING MACHINE WITH LOWER FEED MECHANISM

[75] Inventors: Gernot Nedoschinsky, Leonberg; Dieter Schopf, Gerlingen; Johannes Strauss, Leinfelden, all of Germany

[73] Assignee: Union Special GmbH, Hemmingen, Germany

[21] Appl. No.: 353,077

[22] Filed: Dec. 9, 1994

[30] Foreign Application Priority Data

Dec. 15, 1993 [DE] Germany ..... 43 42 682.4

[51] Int. Cl.[6] ..... D05B 27/24

[52] U.S. Cl. ..... 112/323

[58] Field of Search ..... 112/323, 324

[56] References Cited

U.S. PATENT DOCUMENTS

| | | | |
|---|---|---|---|
| 1,148,446 | 7/1915 | De Voe | 112/323 |
| 1,250,437 | 12/1917 | De Voe | 112/323 |
| 1,927,489 | 9/1933 | Clayton | 112/323 |
| 2,996,024 | 8/1961 | Leslie | 112/316 |
| 3,320,913 | 5/1967 | Laidig | 112/323 |
| 4,419,951 | 12/1983 | Ruch et al. | 112/323 |
| 4,624,202 | 11/1986 | Alberti et al. | 112/323 X |

FOREIGN PATENT DOCUMENTS

| | | | |
|---|---|---|---|
| 3116578 | 12/1989 | Germany . | |
| 1641914 | 4/1991 | U.S.S.R. | 112/323 |

*Primary Examiner*—C. D. Crowder
*Assistant Examiner*—Ismael Izaguirre
*Attorney, Agent, or Firm*—Willian Brinks Hofer Gilson & Lione

[57] ABSTRACT

A sewing machine with an arrangement for advancing material for sewing which imparts a lifting and thrust motion to the feed dog. The arrangement for advancing material has a thrust drive which includes a thrust frame that imparts advancing motion of the feed dog. The lifting motion of the feed dog is imparted by a lifting rod that is slidably guided in the thrust frame.

7 Claims, 5 Drawing Sheets

SEWING MACHINE WITH LOWER FEED MECHANISM

BACKGROUND OF THE INVENTION

The invention relates to a sewing machine with an arrangement for advancing the material for sewing that includes a feed dog, a rotating main shaft, a thrust drive having a rocker shaft and a rocker arm and a lifting rod which carries the feed dog and is disposed perpendicular to the main shaft and is in lifting drive connection with the main shaft.

SUMMARY OF THE INVENTION

U.S. Pat. No. 3,478,709, which corresponds to German Offenlegungsschrift No. 1 660 849, discloses a sewing machine including a rotating main shaft having a cam which is surrounded by a coupler which by way of a pin and a rod claw confers a lifting motion to a holding rod bearing a feed dog. A rocking driver that is driven by the main shaft acts through a rocker arm and a second coupler on the pin to confers a thrust motion to the holding rod. The holding rod is movably mounted in a cross-head which in turn is movably disposed on a rod fixed to the housing. This induction of both the lifting and the thrust component to the pin, and thus the holding rod, results in a simple construction for advancing the material for sewing. However, at high stitch rates, e.g. 3000 r.p.m., this prior art sewing machine has unacceptable vibrations and experiences premature wear.

Thus the object of the invention is to develop an arrangement for advancing the material for sewing so as to facilitate low-vibration and low-wear driving of the feed dog.

This objective is achieved by the provision of a thrust frame that is articulated at one end to a rocker arm and is guided at its other end. The thrust frame is also provided with a sliding guide for the lifting rod which carries the feed dog. In this way the thrust motion can be induced separately from the lifting motion of the lifting rod. This results in a compact and stable arrangement which facilitates low-vibration and low-wear driving of the feed dog and thus also quiet running of the arrangement for advancing the material for sewing even at high speeds.

Several embodiments of the mechanism for guiding the other end on the thrust frame are disclosed. Each of these embodiments provide convenient and advantageous developments of the arrangement for advancing the material for sewing.

The following description of the preferred embodiments of the invention serves for further explanation in conjunction with the drawings, in which:

DETAILED DESCRIPTION OF THE PREFERRED EMBODIMENTS

Figure 1:
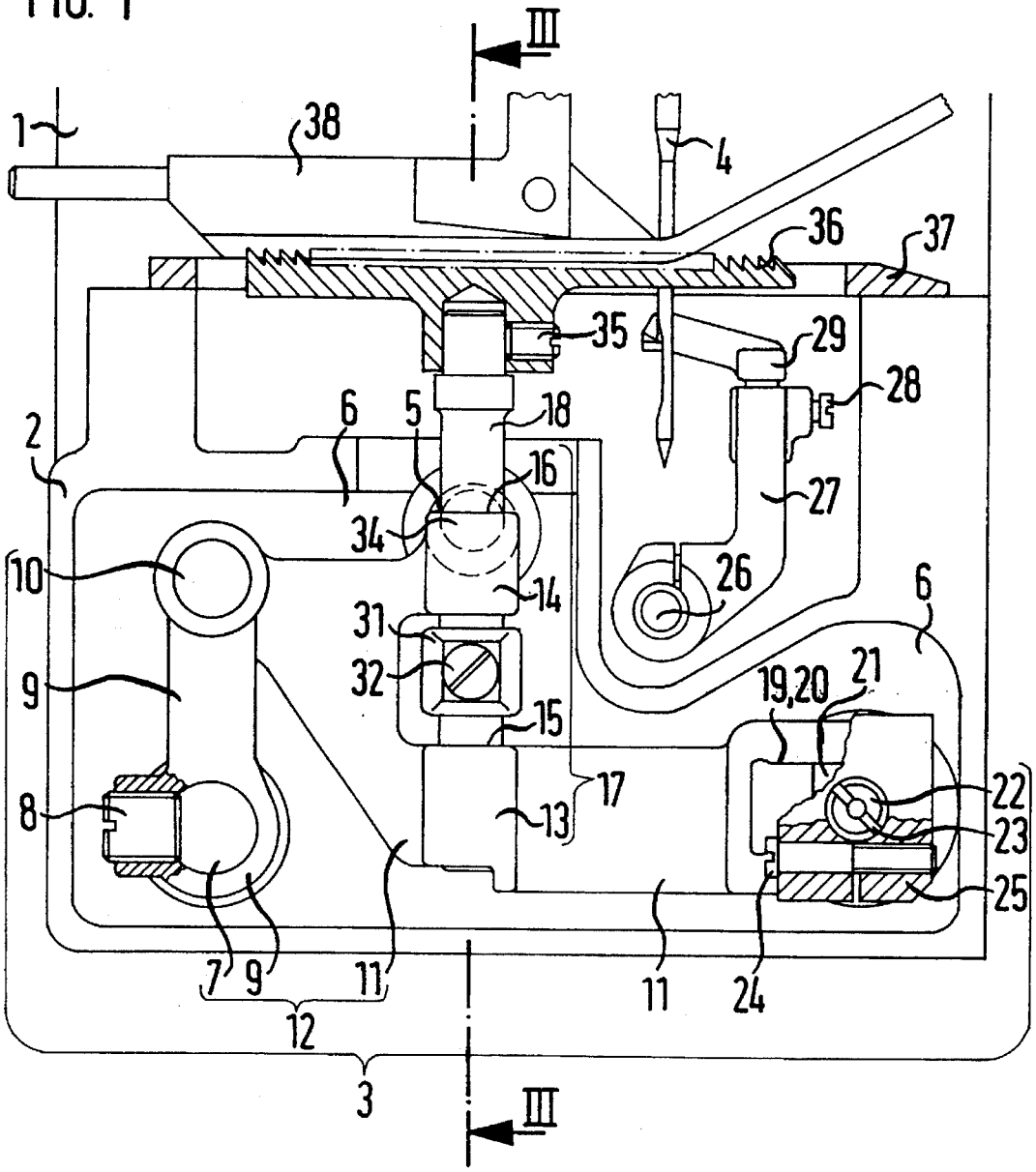
FIG. 1 shows a partially exploded front view of a sewing machine with an arrangement for advancing the material for sewing.

FIG. 1 shows a portion of a sewing machine 1 that includes a lower part 2 in which an arrangement, generally designated 3, for advancing the material for sewing is housed. The arrangement 3 functions to provide a lifting and a thrust motion. A sewing machine needle 4 is included in FIG. 1 and serves to properly orientate the arrangement 3 for advancing the material for sewing. The arrangement 3 is constructed as a lower feed arrangement. A rotating main shaft 5 is mounted in a back wall plate 6 of the lower part 2 and is driven by a motor which is not shown in the drawings. A rocker shaft 7, which is in drive connection with the main shaft 5 by means of an intermediate gear which is not shown in the drawings, is mounted so as to swivel in the back wall plate 6. The rocker shaft 7 has a forked rocker arm 9 fixed to it by a screw 8 and carries a pin 10 at its other end. A thrust frame 11 is articulated or pivotally connected on the forked rocker arm 9 through pin 10 such that this arrangement of parts functions as the thrust drive 12.

The thrust frame 11 has hubs 13 and 14 with aligned cylindrical bores 15 and 16 formed therethrough which form a sliding guide 17 for a lifting rod 18.

Figure 2:
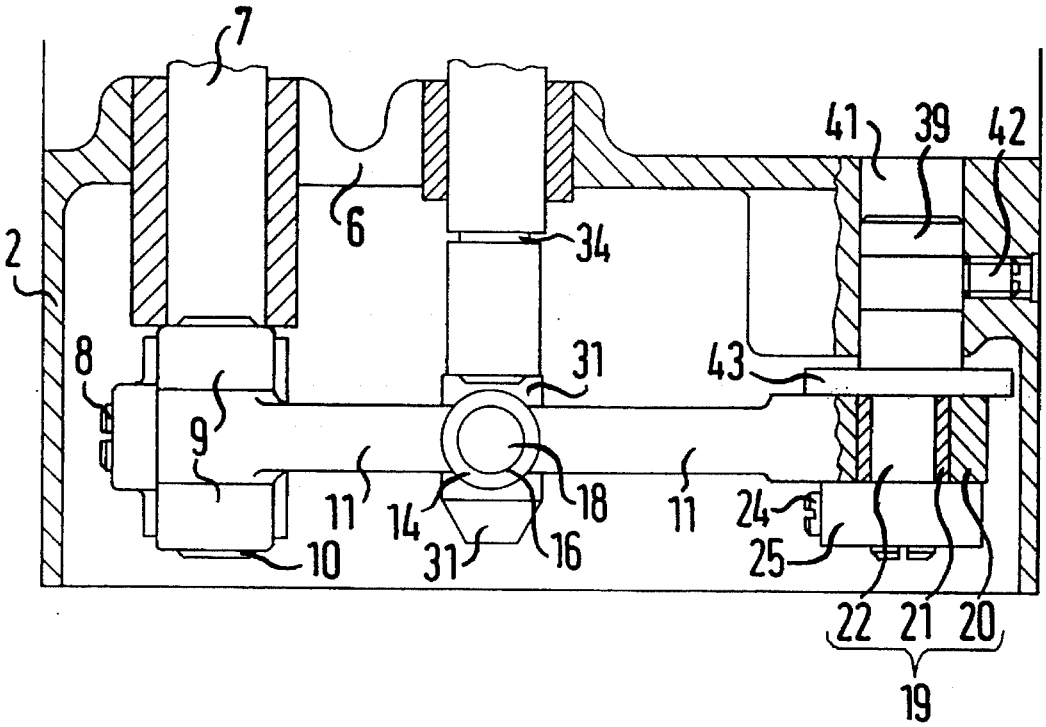
FIG. 2 shows a top view of an arrangement for advancing the material for sewing.

The thrust frame 11 which is guided at one end by means of the forked rocker arm 9 and pin 10 has at the other end a guide including a fork 20 which slidably surrounds a block 210 The block 21 is mounted on an eccentrically disposed pin 22, which in FIG. 2 is disposed in its left end position. Pin 22 has an adjustment slot 23 formed in its free end. Pin 22 extends from the end of cylindrically shaped pin 39 at a point off set from the axis of pin 39. To adjust the position of pin 22, screw 42 is turned to release pin 39 and then pin 21 can be adjusted through its free end slot 23. A claw piece 25, fixed with a screw 24, surrounds the pin 22 and additionally guides the thrust frame 11 laterally.

A looper shaft 26 bears a looper holder 27 on which a looper 29 is secured. Looper 29 cooperates with the sewing machine needle 4.

The lifting rod 18 has a clamping piece 31 fixed to it by a screw 32. The clamping piece 31 is connected by a guide rod 45 to a cam 34 of the main shaft 5. A feed dog 36, also known as sewing material feeder, is fixed by means of a ,screw 35 on the free end of the lifting rod 18. The feed dog 35 projects through openings formed in throat plate 37 and as seen in FIG. 1, as a result of cam 34, is disposed in its upper position. A presser foot 38 together with the feed dog 36 and the throat plate 37 facilitates the intermittent advance of the material for sewing.

FIG. 2 shows an opening 41 formed in the back wall 6 which is the support for a pin 39. The pin 22 is eccentrically disposed with respect to the central axis of pin 39. The pin 39 is adjustably mounted in the opening 41 of the back wall plate 6 of the lower part 2 and can be secured in a selected adjusted positioned by a screw 42. A flange 43 formed on pin 39 serves as a further lateral support for the thrust frame 11.

Figure 3:
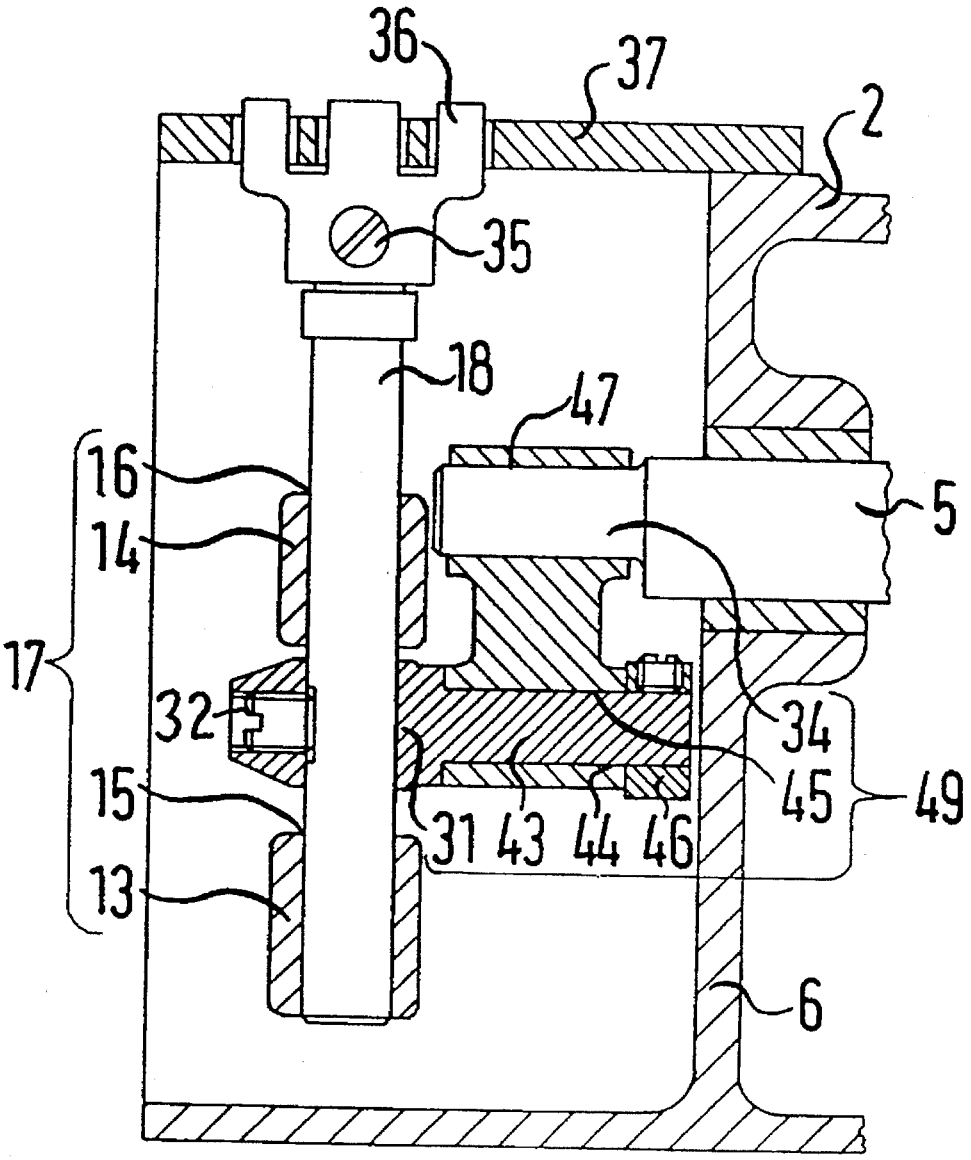
FIG. 3 shows a partial view of the arrangement for advancing the material for sewing according to FIG. 1 along a section line III—III.

According to FIG. 3 the clamping piece 31 includes a pin 43 which is surrounded by a cylindrical bore 44 formed in one end of the guide rod 45. Thus the guide rod 45 is mounted so as to swivel on the pin 43 and is secured against lateral displacement by means of a setting ring 46. A second cylindrical bore 47 is formed in the other end of guide rod 45 which surrounds the cam 34. The cam 34, the guide rod 45 and the clamping piece 31 are part of a lifting drive 49 for lifting rod 18. The cam 34 is offset from the center line of main shaft 5 and thus imparts movement to guide rod 45 the vertical component of which is transmitted to the lifting rod 18.

Figure 4:
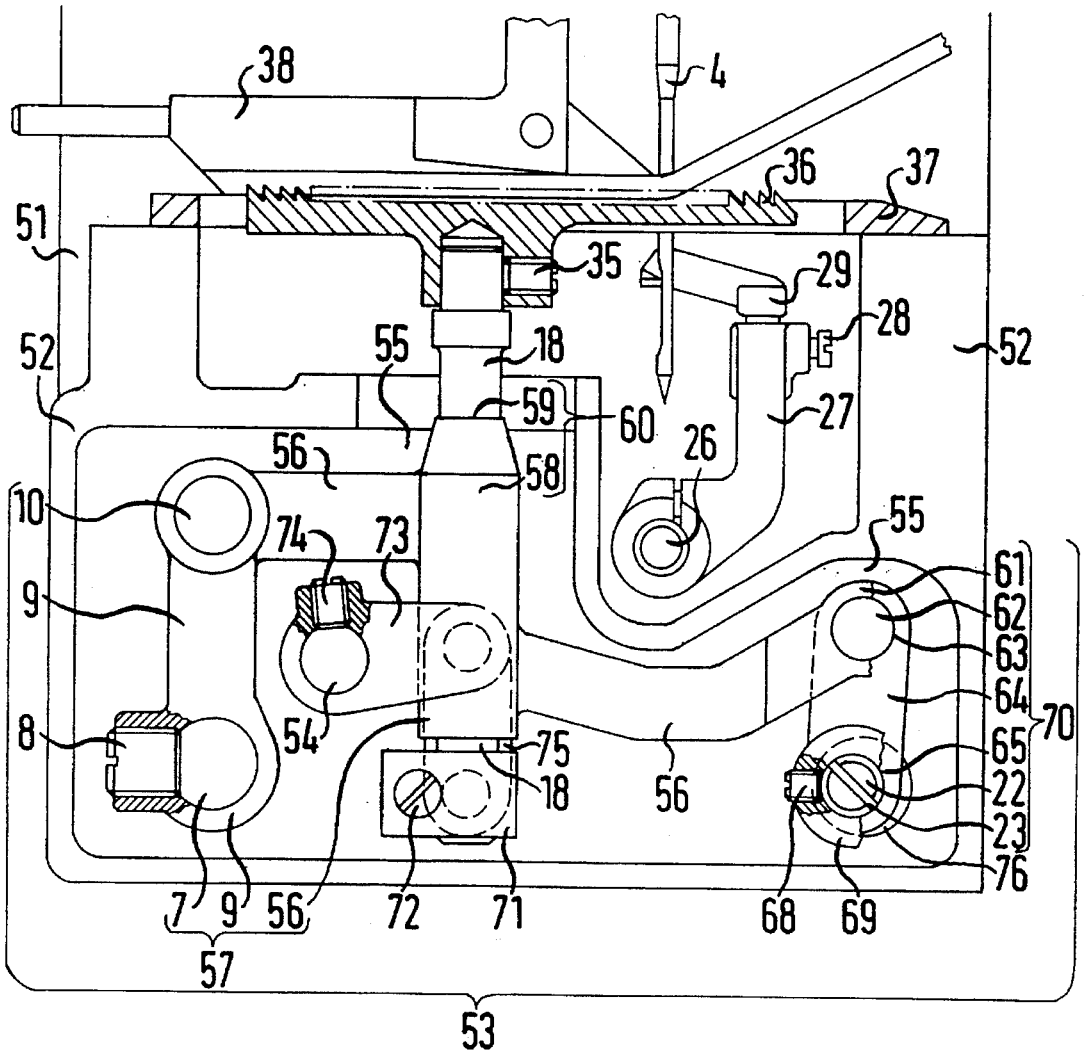
FIG. 4 shows a partially exploded front view of a sewing machine with a further arrangement for advancing the material for sewing and FIG. 5 shows a top view of the further arrangement for advancing the material for sewing.

FIG. 4 shows a second embodiment of a part of a further sewing machine 51 with a lower part 52 in which is embedded a second arrangement 53 for advancing the material for sewing which carries out a lifting and thrust motion. Parts of the sewing machines 1 and 51 which are structurally or functionally the same have the same reference numerals.

A sewing machine needle 4 is included in FIG. 4 and serves to properly orientate the arrangement 53 for advancing the material for sewing. A rocker shaft 54 is mounted so as to swivel in an back wall plate 55 of the lower part 52. The rocker shaft 54 is driven in a known manner by means of an intermediate gear which is not shown in the drawing and is in drive connection with a main shaft and a motor.

The rocker shaft 7 is mounted so as to swivel in the back wall plate 55 and carries the forked rocker arm 9 which is fixed by means of the screw 8. One end of the forked rocker arm 9 is journaled on the pin 10 (see FIG. 5) by means of which the thrust frame 56 is articulated on the forked rocker arm 9. Parts 7, 9, 10, 55 and 56 are part of a thrust drive 57. The thrust frame 56 has a hollow cylinder with an opening 59. The hollow cylinder 58 with the cylindrical bore opening 59 functions as a sliding guide 60 for the thrust rod 18.

The thrust frame 56 which is guided at one end by the forked rocker arm 9 and the pin 10 has at its other end a fork 61 which caries a bolt 62 which is mounted in the upper bore 63 of a rocker arm 64. The lower bore 65 of the rocker arm 64 journals the eccentrically mounted pin 22. Pin 22, is shown in FIG. 4, disposed in its left end position and has an adjustment slot 23.

A setting ring 69 with a screw 68 surrounds the pin 22 and additionally guides the rocker arm 64 laterally. The fork 61 with the bolt 62, the rocker arm 64 and the pin 22 form a guide 70.

The looper shaft 26 carries the looper holder 27, on which the looper 29 is secured by a screw 28. Looper 29 cooperates with the sewing machine needle 4.

The lifting rod 18 has at its lower end a claw piece 71 fixed thereto by a screw 72. The feed dog 36, which projects through the throat plate 37, is fixed on the upper end of the lifting rod by means of the screw 35. The presser foot 38 together with the feed dog 36 and the throat plate 37 facilitates the intermittent advance of the material for sewing.

The rocker shaft 54 has a lever 73 fixed thereto by a screw 74. A rocker arm 75 is pivotally connected at its ends to the lever 73 and to the claw piece 71.

Figure 5:
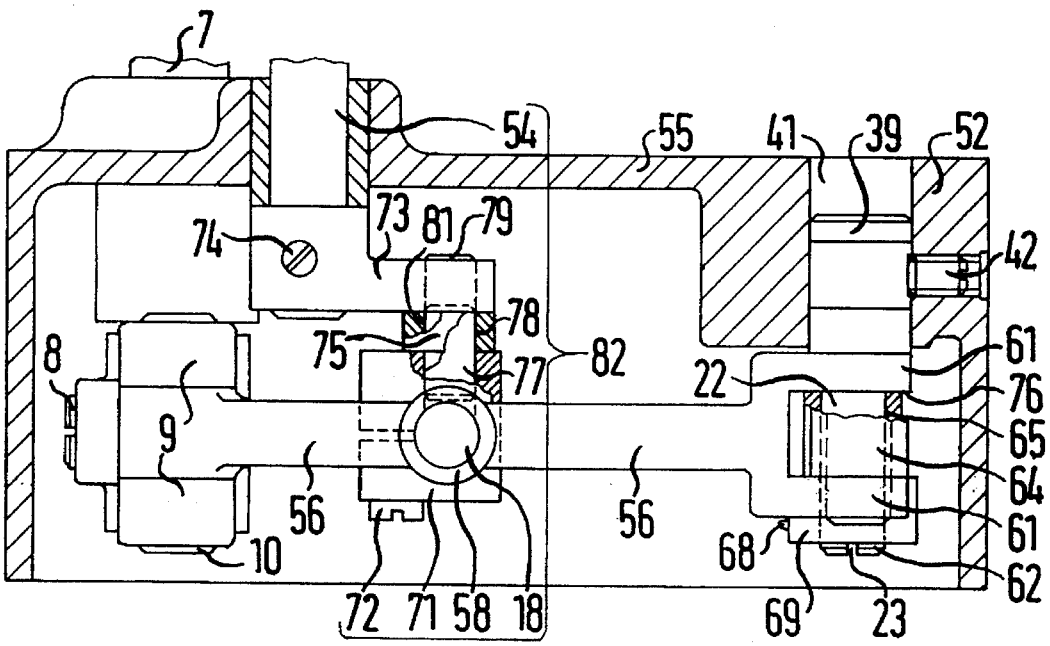

FIG. 5 shows the mounting of the pin 39 in opening 41 formed in the back wall plate 55. The pin 39 is adjustably mounted in the opening 41 of the back wall plate 55 of the lower part 52 and can be secured in a selected adjusted positioned by means of the screw 42. A shoulder 76 of the pin 39 serves as a further lateral support for the rocker arm 64.

FIG. 5 also shows the pin 77 which protrudes into a lower bore 78 of the rocker arm 75 is journaled in the claw piece 71. A second pin 79 which protrudes into an upper bore 81 of the rocker arm 75 is journaled in the lever 73. The claw piece 71 with the pin 77, the rocker arm 75, the lever 73 with the pin 79 and the rocker shaft 54 are parts of a lifting drive 82.

In both arrangements 3 and 53 for advancing the material for sewing the thrust motion of the feed dog 36 is induced by means of the rocker shaft 7. This induction of the thrust motion of the feed dog 36 takes place in the arrangement 3 for advancing the material for sewing through a cam 34 and in the arrangement 53 for advancing the material for sewing through the rocker shaft 54.

In both embodiments of the invention the pin 22, which is a part of pin 39, is mounted in the lower part 2 or 52 and is adjustable through the slot 23 that is formed in its free end. Since the pin 22 extends eccentrically from the center line of the pin 39, the pin 22 can be adjusted, by releasing pin 39 by turning screw 42 and turning pin 22 through the slot 23. This adjustment makes it possible to incline the feed dog 36 with respect to the feeding plane or arrangement for advancing the material for sewing. Depending upon the material to be sewn, e.g. closing sacks or bags made of paper or plastic, this can prevent damage to the surface of the material being sewn during feed or advancing.

We claim:

1. In a sewing machine of the type in which the arrangement for advancing the material for sewing includes a feed dog, a rotating main shaft, a thrust drive having a rocker shaft and a rocker arm, and a lifting rod which is connected to the feed dog, is disposed perpendicular to the main shaft and is in lifting drive connection with the main shaft, wherein the improvement comprises:

a thrust frame including ends, said thrust frame is pivotally connected at one end to said rocker arm, said thrust frame includes a sliding guide and said lifting rod slides thereon, said thrust frame also includes a guide at its other end that includes a fork and a block, and wherein said fork surrounds said block.

2. A sewing machine as claimed in claim 1, wherein said block is mounted to pivot on a pin.

3. A sewing machine as claimed in claim 2, wherein said pin is disposed eccentrically on an adjustable pin.

4. A sewing machine as claimed in claim 1, wherein said guide at its other end includes a second rocker arm on which said thrust frame is articulated.

5. A sewing machine as claimed in claim 4, wherein said rocker arm is mounted to swivel about a pin.

6. A sewing machine as claimed in claim 5, wherein said pin is disposed eccentrically on an adjustable pin.

7. A sewing machine as claimed in claim 1, wherein said sliding guide includes an opening in which said lifting rod is slidably guided.

* * * * *